United States Patent [19]

Grigoriev et al.

[11] 4,074,773

[45] Feb. 21, 1978

[54] HOLE DRILLING MACHINE

[76] Inventors: Vladimir Konstantinovich Grigoriev, 1 Streletsky pereulok, 3, kv. 24, Moscow; Viktor Dmitrievich Chugunov, Solnechnogorsky raion, stantsia Povarovo, poselok 2, dom 4, kv. 13, Moskovskaya oblast; Mikhail Nikolaevich Kudryakov, ulitsa Zholtovskogo, 27, kv. 10, Moscow; Alexandr Moiseevich Tsipkis, Ananievsky pereulok, 4/2, kv.121, Moscow; Vladimir Germogenovich Yakovlev, proezd Kirova, 6a, kv. 7, Moscow; Alexandr Samoilovich Averbukh, ulitsa Krasikova, 16, korpus 1, kv. 52, Moscow; Jury Ilich Scherbakov, Pushkinsky raion, stantsia Tarasovskaya, ulitsa B. Tarasovskaya, 39, Moskovskaya oblast; Natalia Dmitrievna Yakobson, Chernomorsky bulvar, 7, korpus 4, kv. 233, Moscow; Vyacheslav Fedorovich Semikozov, Vishnyakovskaya ulitsa, 6, korpus 5, kv. 29, both of Moscow; Viktor Vladimirovich Medvedev, prospekt Lenina, 23/40, kv. 110; Valery Vasilievich Yartsev, prospekt Lenina, 23/40, kv. 109, both of Nizhny Tagil; July Davydovich Kaganov, Yartsevskaya ulitsa, 28, korpus 1, kv. 66, Moscow; Vladimir Ivanovich Kuznetsov, ulitsa Kantemirovskaya, 5, korpus 2, kv. 320, Moscow; Alexandr Iosifovich Sinelnikov, Oxkaya ulitsa, 36, korpus 2, kv. 47, Moscow, all of U.S.S.R.

[21] Appl. No.: 693,285

[22] Filed: June 7, 1976

[51] Int. Cl.[2] ..... E21C 11/02

[52] U.S. Cl. ..... 173/23; 173/28; 173/43

[58] Field of Search ..... 173/23, 24, 28, 42, 173/43, 45; 248/13

[56] References Cited

U.S. PATENT DOCUMENTS

| | | | |
|---|---|---|---|
| 3,334,849 | 8/1967 | Bronder | 248/13 |
| 3,642,075 | 2/1972 | Wills | 173/28 |
| 3,917,005 | 11/1975 | Cannon et al. | 173/43 |
| 3,919,816 | 11/1975 | Ranft | 173/28 |

*Primary Examiner*—Robert A. Hafer

[57] ABSTRACT

The drlling machine has a bogie accommodated within a gantry frame, the gantry frame carrying the drilling tools and the jacks. In the drilling position and in the gantry position of the machine the gantry frame bears by the jacks upon the ground and with the jacks lifted off the ground the frame bears upon the bogie. The drilling machine has a mechanism for lifting the bogie and a beam with a mechanism effecting displacement of the beam in a direction transverse to the longitudinal geometric axis of the bogie, as well as projectable abutments onto which the gantry frame bears in the transportation position of the drilling machine, the frame having flexible operative connection with the bogie lifting mechanism.

7 Claims, 15 Drawing Figures

HOLE DRILLING MACHINE

BACKGROUND OF THE INVENTION

The invention relates to machines or rigs for drilling holes, e.g. blast holes for driving drifts of medium to small section with the employment of the blasting method.

There are known gantry-type drilling rigs with hydraulically operated drilling booms, intended for drilling blast holes and operable in underground drifts provided with rail tracks.

The most similar in structure to the drilling rig of the present invention is the one marketed by Ingersoll-Rand World Trade Limited and disclosed in the U.S. Pat. No. 3,334,849, Cl. 248–13, patented in 1967.

The drilling rig disclosed in this patent includes a frame and at least one drilling boom pivotally supported by the frame and adapted to support a drilling tool.

At each side of the frame there are mounted interconnected supports or legs, at least one of these legs being pivotally connected with the frame.

The known drilling rig includes also a hydraulic mechanism for actuating the legs pivotally connected with the frame, whereby the rig can be adjusted for transporting purposes from a drilling position in which the frame is supported by the legs bearing upon the ground of the drift.

One of the legs has an arm-like extension projecting beyond the pivot pin about which the leg is mounted on the frame. This arm-like extension is connected with the frame by means of a hydraulic cylinder which effects swinging of the leg about its pivot pin.

In the abovedescribed known drilling rig another leg has arms mounted on the frame for pivoting about a vertical axis, whereby the rig can be adjusted for transporting purposes.

The provisions for varying the overall dimensions of a drilling machine at transportation and at drilling offer certain advantages.

The Ingersoll-Rand World Trade Limited has developed a gantry type drilling rig supported on rails, wherein there has been utilized the abovedescribed structural method of varying the overall dimensions of the rig by folding its members on the frame for transporting purposes.

The gantry type drilling ring incorporates a housing supporting thereon hydraulically actuated drilling booms, the housing being supported on rails by means of two pairs of wheels. The rig further incorporates jacks by means of which the housing of the rig together with the drilling booms can be lifted to the roof of the drift, so that load-carrying and like machines and vehicles should be able to pass under the rig.

However, the abovedescribed known rig is not free from disadvantages.

One of the disadvantages arises from the housing of the rig being situated relatively high above the ground of the drift, which increases the total height of the rig in the gantry position and complicates the operation of the rig in relatively small-height drifts, making it virtually impossible to pass load-carrying and handling means of a considerable height under the gantry.

The relatively high position of the housing is explained by the kinematics of folding the legs of the rig, which means that the pivot pins of the arms should be above the wheels of the rig, so that the legs should be lifted higher than the wheels and ensure sufficient ground clearance at transportation. Furthermore, the abovedescribed rig cannot be transported without disassembling along single-track drifts of relatively small cross-sectional area wherein the central axis of the track is considerably displaced from the central axis of the drift.

The operator's place on the known drilling rigs in the drilling position is also relatively high above the ground of the drift, which involves additional difficulties in operating the rig.

Although the gantry type drilling rig marketed by the Ingersoll-Rand World Trade Limited is more vibration-stable than the structures that had preceded this rig, however, it is not completely free from the vibration hazard.

SUMMARY OF THE INVENTION

It is an object of the present invention to create a hole drilling machine which should enable transporation of this machine along single-track drifts of relatively small section, wherein the axis of the rail track is considerably displaced from the axis of the drift.

It is another object of the present invention to create a hole drilling machine which should be operable in both straight and curving drifts.

These and other objects are attained in the herein disclosed machine for drilling holes at driving of mining drifts of small to medium cross-sectional area, including a bogie accommodated within a gantry frame supporting the drills and the jacks by means of which the gantry frame bears upon the ground at drilling and in the gantry position, the frame being adapted to be supported by the bogie in the transportation position, with the jacks lifted off the ground, and a mechanism for lifting the bogie. In accordance with the present invention, the bogie has mounted thereon at least one beam movable in a direction transverse to the longitudinal geometric axis of the bogie, the beam supporting thereon a mechanism for effecting the said movement and projectable abutments upon which the gantry frame bears on transportation of the machine, the frame having flexible kinematic connection with the bogie lifting mechanism.

It is expedient that the beam should have side lugs and the bogie should include guides supporting these side lugs of the beam, and that the mechanism for effecting motion of the beam in a direction transverse to the longitudinal geometric axis of the bogie should include a fluid cylinder fixedly mounted on the bogie and having piston rods projecting from the cylinder at both sides of the piston, the rods being adapted to cooperate with the side lugs of the beam.

In this way the machine can be made more compact.

It is further expedient that the bogie lifting mechanism should include a driven shaft carrying at least one drum having the end of a rope attached thereto, the other end of the rope being attached to the upper portion of the gantry frame, and that the drive of the bogie lifting mechanism should include a pair of fluid cylinders arranged along a single geometric axis and having the movable members thereof interconnected so that in the area of this interconnection there should be mounted a toothed rack permanently meshing with a toothed rim fast with the driven shaft.

With the bogie lifting mechanism having this structure the bogie can be lifted to the upper portion of the gantry frame, so that load handling and carrying machines and vehicles should be able to pass under the drilling machine.

It is further expedient that each one of the projectable abutments of the frame should include a Z-shaped lever having one arm thereof mounted on the beam by means of a pivot pin extending vertically, the other arm being adapted to support the gantry frame in the transportation position of the machine, which should enable lifting the bogie to the upper portion of the gantry frame and to pass load handling and carrying machines and vehicles under the drilling machine.

It is a still further expedient that the bogie should be provided with a slewing circle situated centrally of the bogie and carrying the guideways of the beam and the fluid cylinder and effecting motion of the beam in a direction transverse to the longitudinal geometric axis of the bogie and having the rods cooperable with the side lugs of the beam, which should enable the drilling machine to pass through curving drifts.

As a result of the present invention, there has been created a drilling machine capable of moving along single-track drifts of relatively small cross-sectional area, wherein the axis of the rail tracks is considerably displaced from the axis of the drift, and also capable of driving both straight and curving drifts.

BRIEF DESCRIPTION OF THE DRAWINGS

The present invention will be further described in connection with an embodiment thereof, with reference being had to the accompanying drawings, wherein.

DESCRIPTION OF THE PREFERRED EMBODIMENTS

Figure 1:
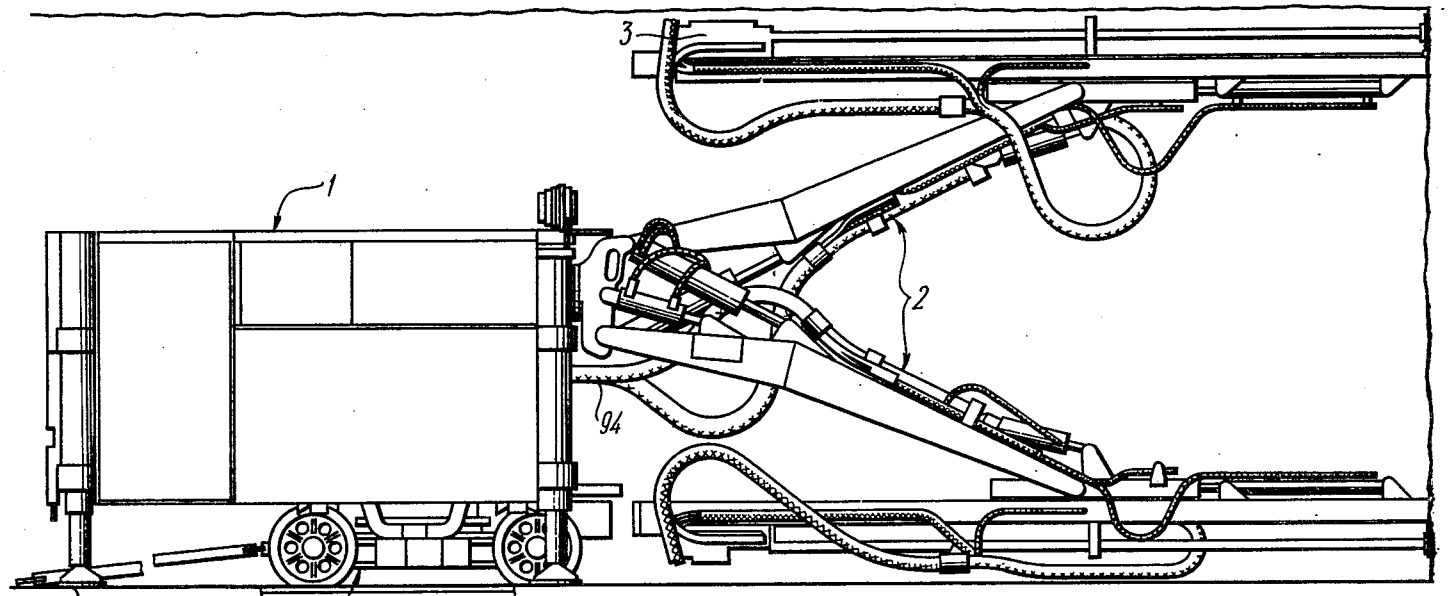
FIG. 1 is a side elevation of a drilling machine for drilling blast holes at driving of drifts in mining, constructed in accordance with the invention.

Referring now in particular to the appended drawings, there is illustrated in FIG. 1 a machine for drilling blast holes at driving of mine drifts of small to medium cross-sectional area.

The machine has a gantry 1 supporting thereon drilling booms 2, each boom 2 having mounted thereon a drill 3. The gantry frame is provided with support jacks 4 adapted to bear upon the ground of the drift in the drilling position of the machine and also adapted to set the machine to the gantry position.

The gantry frame 1 is connected with a bogie 5 intended for transportation of the machine and having two frames.

The bottom frame 6 (FIG. 2) of the bogie supports driven wheels 7 associated with a transportation drive 8. The drive 8 includes a pneumatic motor 9 and a worm-type reducer 10, the rear wheels 11 of the bogie 5 being non-driven ones.

To provide for the machine being towed by an electric mine locomotive or any other external means, there are incorporated a mechanism 12 (FIG. 3) for disabling the transportation drive and a device 13 (FIG. 2) for coupling the bogie to the locomotive.

The bogie 5 is equipped with a compressed air conduit 14 connectable to the compressed air mains of the mine.

The bogie 5 supports a mechanism 15 for moving the gantry frame 1 in a direction transverse to the longitudinal geometric axis of the bogie.

This transverse motion mechanism 15 includes a beam 16 with lugs **16*a* bearing upon supporting guiding rollers 17. The motion of the beam is effected by a fluid cylinder 18 (FIG. 3) having piston rods 19 projecting therefrom to both sides of the pison (not shown) and operatively associated with the beam 16**.

The fluid cylinder 18 has a housing 20 mounted by means of clamps 21 on the top frame 22 (FIG. 2) of the bogie 5.

The ends of the beam 16 (FIG. 2) have pivotally mounted thereon levers 23 (i.e., the projectable abutments), the pivot pins 24 supporting with these levers extending vertically.

The levers 23 support thereon the gantry frame 1 (FIG. 15) when the drilling machine is transported along the drift.

Figure 4:
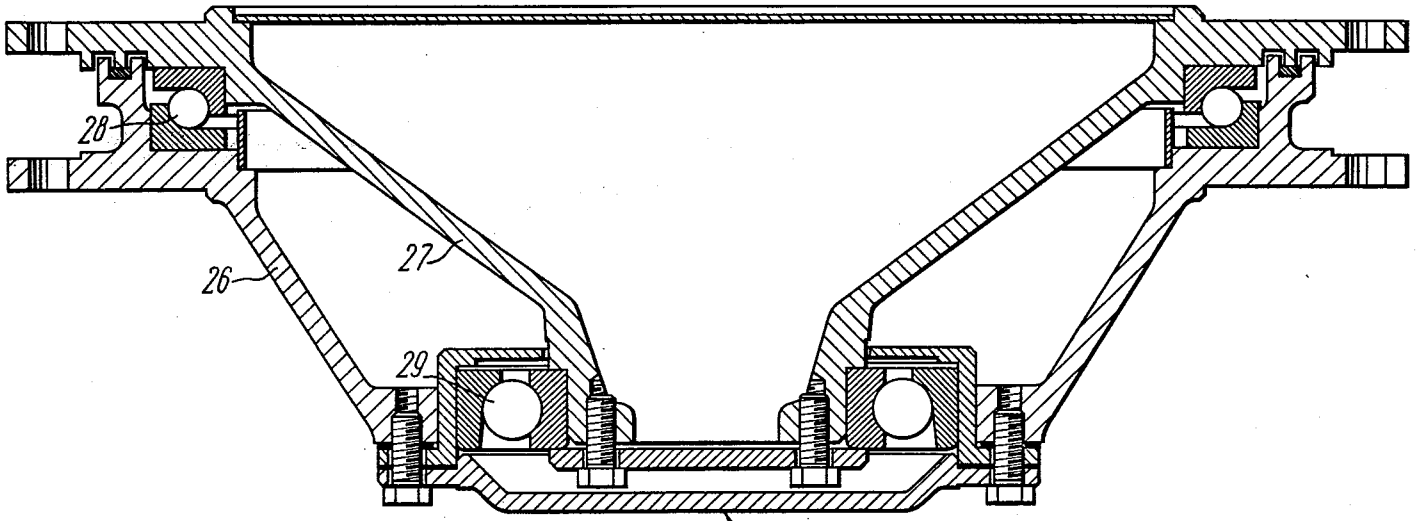
FIG. 4 is an enlarged vertically sectional view of the slewing mechanism 25 shown in FIG. 2.

The central portion of the drilling machine is arranged to provide for slewing of the gantry frame 1. The slewing mechanism or slewing circle 25 (FIGS. 2 and 4) of the portal frame 1, providing for rotation of the latter about a vertical geometric axis, includes two housings, i.e. the external housing 26 (FIG. 4) mounted on the bottom frame 6 (FIG. 2) and the internal one 27 (FIG. 4) mounted on the top frame 22 (FIG. 2), the two housings being operatively connected through antifriction bearings 28 and 29 (FIG. 4).

The slewing motion of the gantry frame about the vertical axis is effected by a fluid cylinder 30 (FIG. 2) of which the housing is pivotally connected to the bottom frame 6 of the bogie 5 and the piston rod 30a is pivoted to the slewing mechanism 25.

Figure 6:
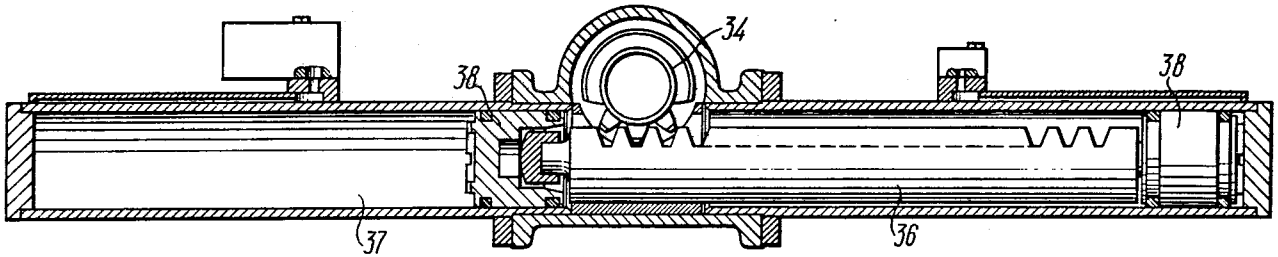
FIG. 6 is a longitudinally sectional view of the hydraulic cylinder 37 with the rack 36 of the mechanism 31 for lifting the bogie.
Figure 7:
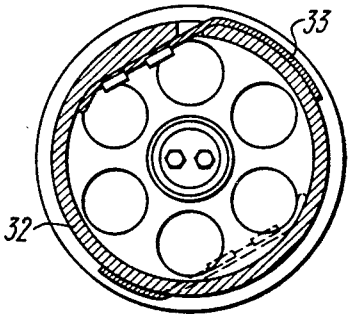
FIG. 7 is a sectional view on line VII—VII of FIG. 5.
Figure 5:
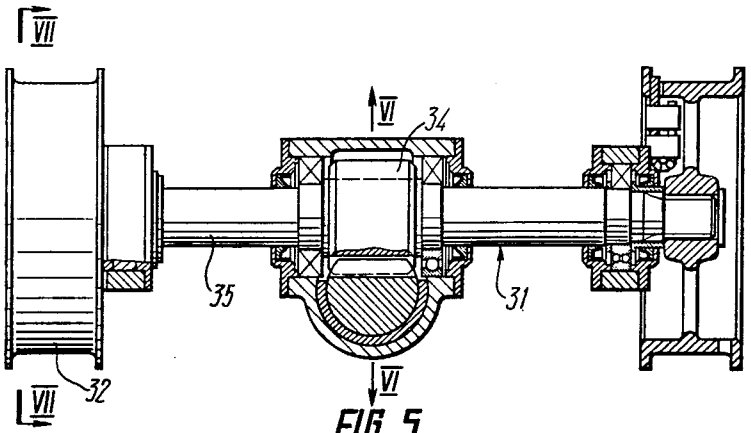
FIG. 5 is a sectional view on line V—V of FIG. 2.

The top frame 22 has mounted thereon a mechanism 31 for lifting the bogie 5 to the upper portion of the gantry frame 1. The bogie lifting mechanism 31 (FIG. 5) includes drums 32 having ropes 33 (FIG. 7) wound thereon and also includes a toothed rim 34 (FIG. 6) fast with a shaft 35 (FIG. 5) carrying the drum 32.

The toothed rim 34 meshes with a toothed rack 36 (FIG. 6) mounted in a twin hydraulic cylinder 37 between the pistons 38.

The drum 32 (FIG. 7) has one end of the rope 33 attached thereto, the other end of this rope being attached to the upper portion of the portal frame 1.

The bogie 5 has arranged thereon a control console 39 (FIG. 3) with the following push-button controls:

buttons 40 for controlling the levers (the right-hand button is depressed to spread the levers, and the left-hand one is depressed to fold them in);

gantry transverse motion buttons 41 (the left-hand and right-hand ones, respectively);

bogie lifting/lowering buttons 42 (the left one being "down" button and the right one being "up" button);

gantry slewing buttons 43 (the left-hand and right-hand ones being depressed for clockwise and counter-clockwise rotation, respectively).

When one of the buttons on the control console 39 is depressed, compressed air is directed into the respective one of the air-operated valves arranged on a panel 44 (FIG. 2) and operates this valve, whereby the respective working fluid is directed to the fluid cylinder of the bogie.

In accordance with the control push-buttons of the control console 39, the control valve panel 44 houses: a lever control valve 45, a gantry frame transerve motion control valve 46, a bogie lifting/lowering control valve 47 and a gantry frame slewing control valve 48.

The gantry frame 1 (FIG. 8) is a metal structure with two frameworks 49 and 50 — the right-hand and left-hand ones, respectively — accommodating therebetween an oil pumping station 51.

The frameworks 49 and 50 also support the mechanisms 52 for rotating the drilling booms 2 (FIG. 1), fed via a hydraulic conduit 53 and manifolds "q" of the air and oil lines of these booms.

To illuminate the face area, an electric station 54 is provided (FIG. 10) on the gantry frame 1.

The oil pumping station 51 communicates with the devices on a hydraulic panel 55 housing the safety valve 56 of the entire oil-pressure system of the machine and slide valves 57 with actuators 58.

Hydraulic panels 59 (FIG. 9) associated with the boom control mechanisms are mounted behind the boom rotation mechanisms 52.

Figure 8:
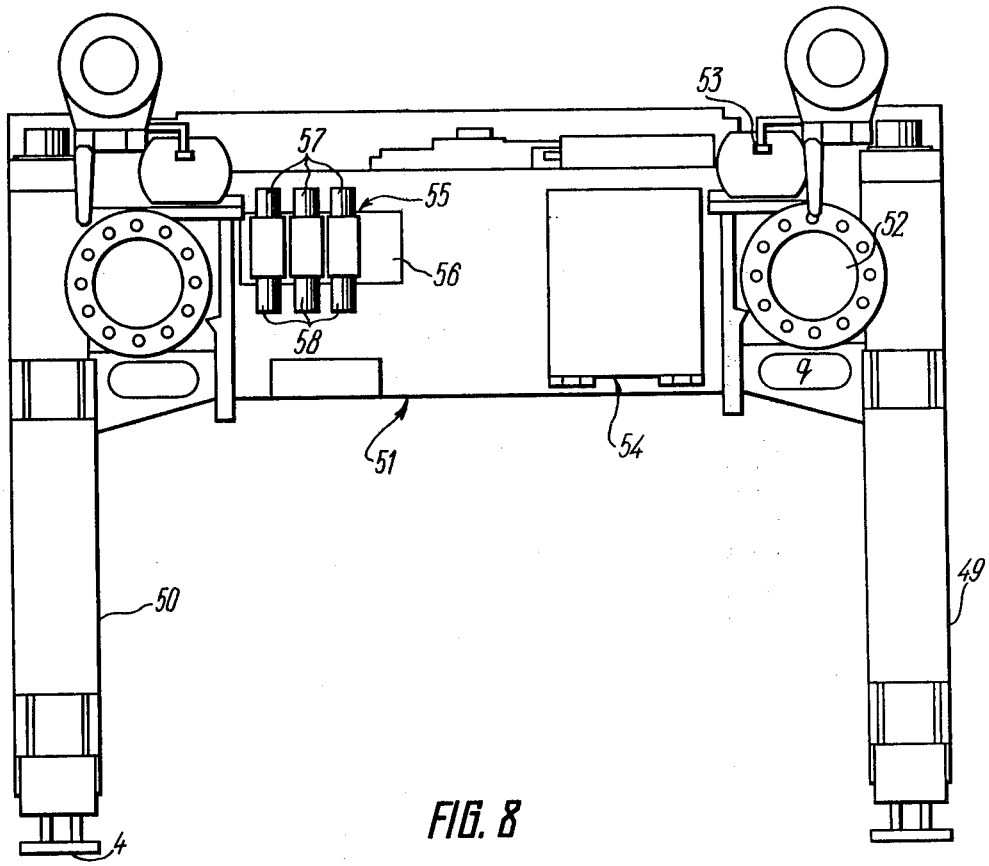
FIG. 8 is a detailed front elevation of the gantry frame 1 of FIG. 1.

The frameworks 49 and 50 (FIG. 8) have mounted therein a drilling control console 60 (FIG. 9) and a portable console 61 for controlling travel of the bogie 5 (FIG. 2) and the support jacks 4 (FIGS. 1 and 8). The portable console 61 (FIG. 9) is connected to the frame 1 via a flexible air conduit 62.

The frameworks 49 and 50 also support the air valves 63 associated with the rotary drives of the drills 3 (FIG. 1), the air valves 64 (FIG. 9) associated with percussive drills, the air valves 65 controlling the feed to the face, the blow-control air valves 67, the flushing control valves 68 and water feed rate sensors 69.

The gantry frame 1 has mounted thereon two bumpers 70 which also act as counterweights.

Figure 10:
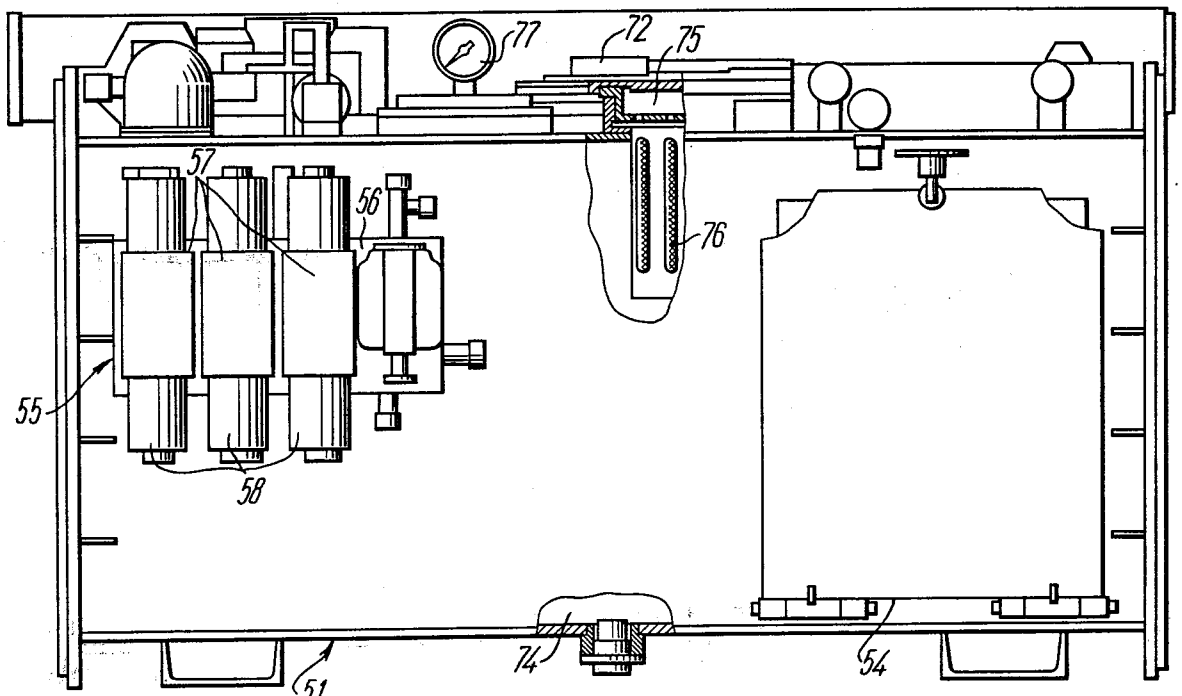
FIG. 10 shows in more detail the oil pumping station 51 of FIG. 8.
Figure 11:
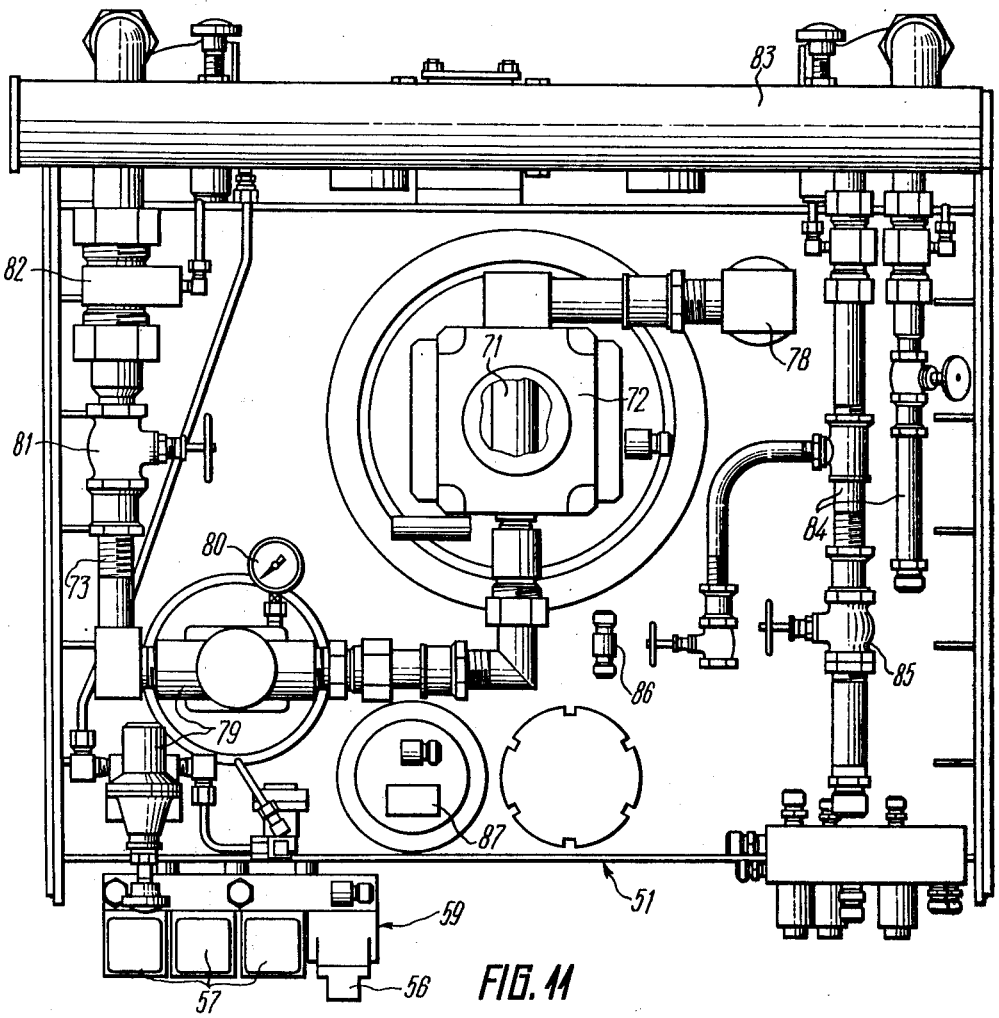
FIG. 11 is the plan view of the same pumping station.

The oil pumping station 51 (FIG. 10) includes a pump 71 (FIG. 11) coupled to a motor 72 and valves 73 controlling this motor. The pumping station 51 is divided into four compartments one of which is occupied by an oil tank 74 (FIG. 10). The right-hand compartment of the pumping station is occupied by the electric station 54. Oil is poured into the oil tank 74 via a filling tube 75 equipped with a filter 76. The pressure gauge 77 indicates pressure in the oil line. The motor 72 is equipped with a silencer 78 (FIG. 11). Compressed air is fed to the motor 72 via an air conduit 79 equipped with a pressure gauge 80, a control valve 81 and an oil jet 82 provided for lubrication of the motor 72.

The pumping station incorporates a manifold 83 and an air conduit 84 with a control valve 85 for supplying compressed air to the drive 8 (FIG. 2) of the bogie.

The pumping station 51 has also mounted therein an inlet 86 (FIG. 11) belonging to the oil drain line and a filter 87 of the oil system of the drilling machine.

Figure 12:
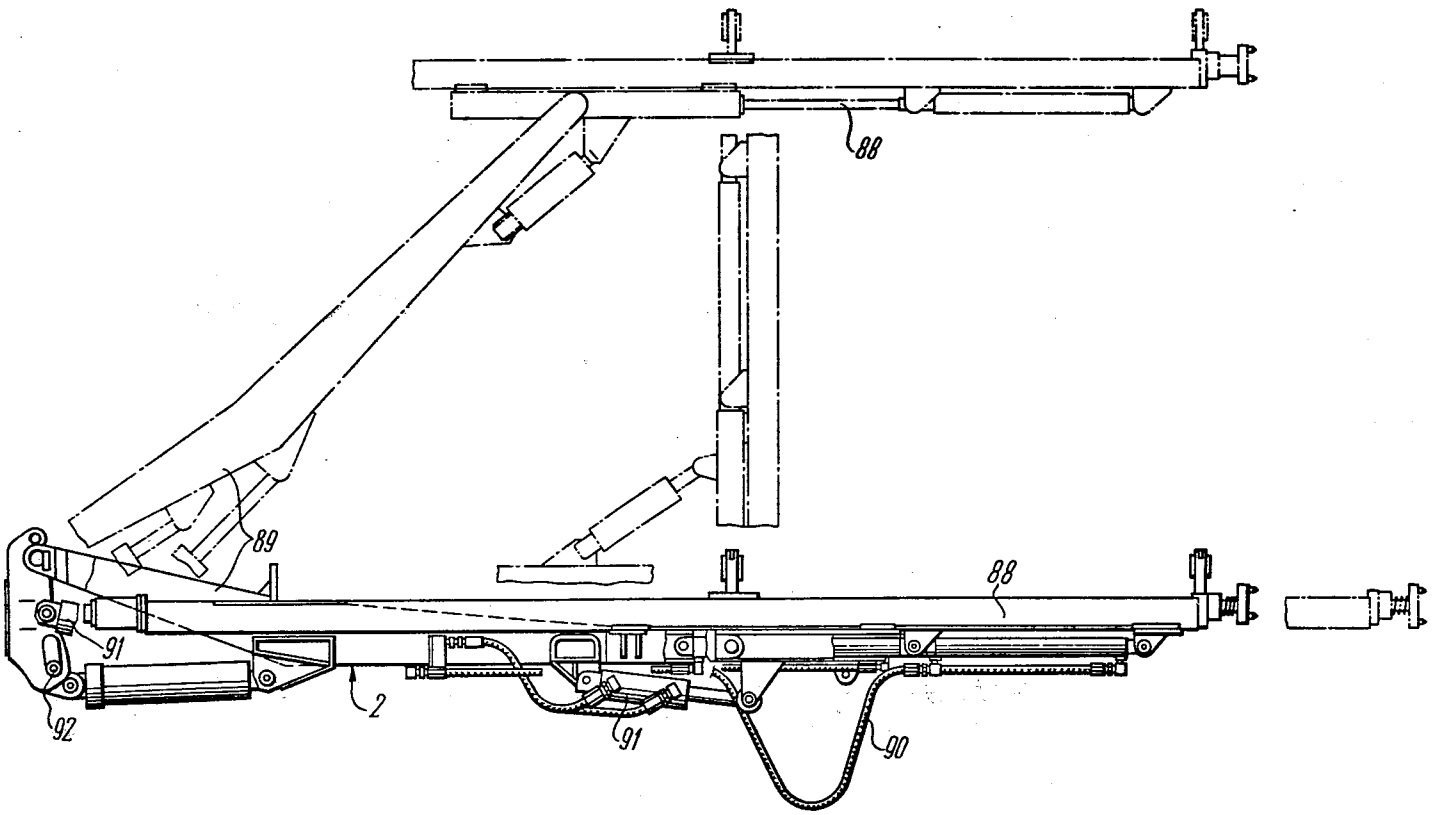
FIG. 12 shows in more detail the drilling boom 2 of FIG. 1.

The drilling machine of the presently described embodiment carries two drilling booms 2 (FIGS. 1 and 12).

The hydraulically-operated drilling boom 2 incorporates an automatic push-feed device 88 and a manipulator 89 movably connected with the push-feed device. The boom 2 also carries an oil conduit 90. The manipulator 89 includes a parallelogram linkage 91 ensuring automatically that the blast holes being drilled are parallel to one another.

The manipulator also includes a correcting device 92 essential for automatic operation of the push-feed device 88, compensating for the travel of the push-feed device from the face, caused by lifting and lowering of the manipulator 89.

It should be stated that the herein described embodiment of the hole drilling machine incorporates known per se air-operated control and automation members, while the mechanisms of the machine are actuated and driven by known per se hydraulic cylinders and air motors.

In the description of the operation of the hole drilling machine to follow hereinbelow the drilling position is chosen as the initial one. The machine operates, as follows.

Figure 9:
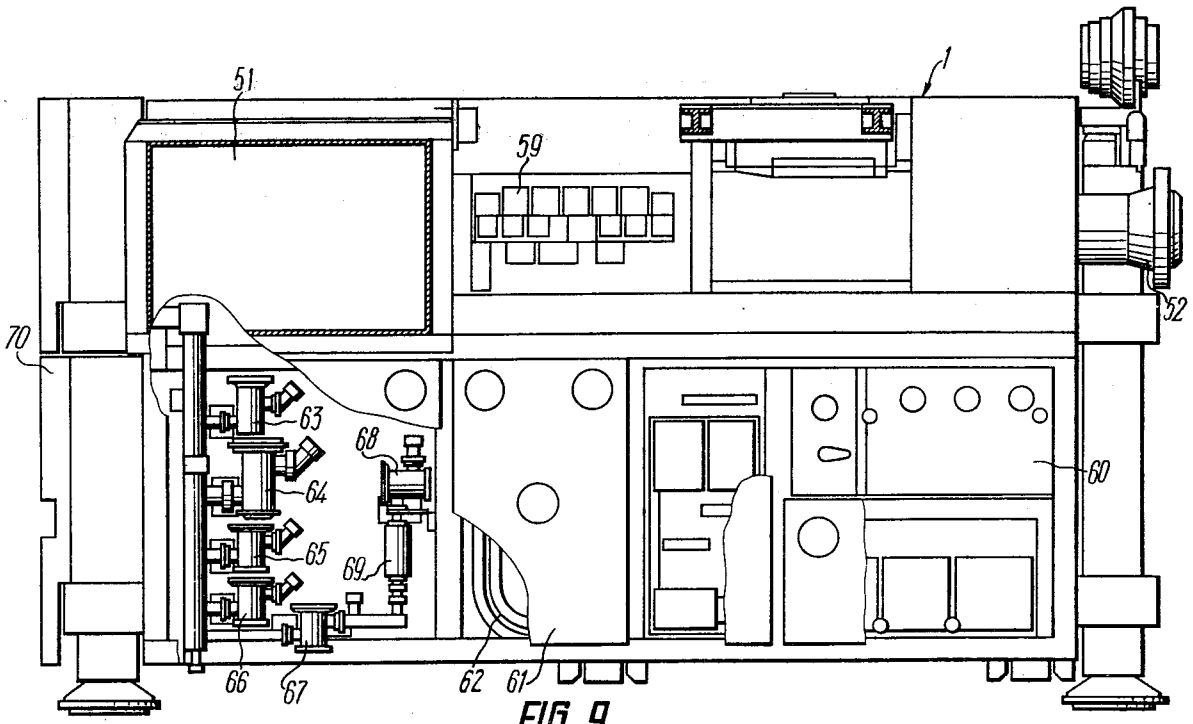
FIG. 9 is a partly broken away side elevation of the same gantry frame.
Figure 13:
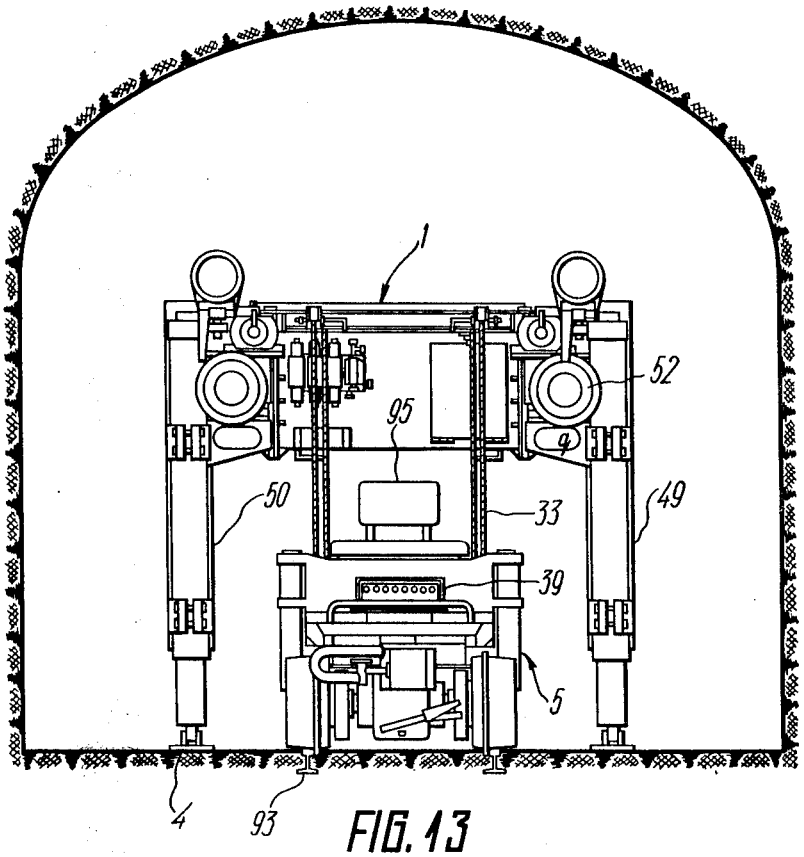
FIG. 13 is a front elevation of the hole drilling machine in the drilling position.
Figure 14:
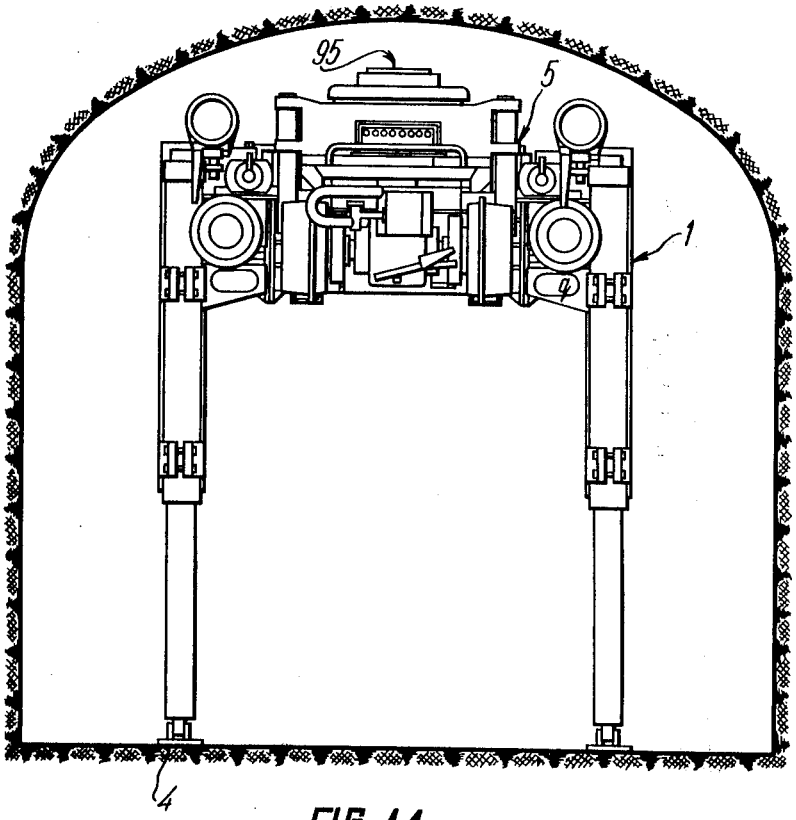
FIG. 14 is a front elevation of the hole drilling machine in the gantry position.

In the drilling position (FIGS. 1 and 13) the gantry frame is supported on the jacks 4 bearing upon the ground of the drift; the bogie 5 is supported by rails 93, the ropes 33 are slack. As it has been already described one end of each rope is attached to the respective drum 32 (FIG. 7) of the bogie lifting/lowering mechanism 31, while the other end is secured to the upper portion of the gantry frame 1 (FIG. 9). Therefore, the bogie 5 is connected to the gantry frame 1 via a flexible connection, whereby vibration caused by operation of impact drills 3 (FIG. 1) is not transmitted to operator's position 95 (FIG. 13). The operator from this position controls the drilling operation.

This control is effected with the help of the control consoles 60 (FIG. 9) situated on the right-hand framework 49 (FIG. 8) and the left-hand framework 50 of the gantry frame 1.

Using the manipulator control console 60, the operator sets the drilling booms 2 (FIG. 1) to a blast hole drilling position and then derpesses the "hole starting" button (not shown), whereby compressed air is supplied via conduits 94 (FIG. 1) from the manifold "q" (FIG. 8) to the percussive drill 3 (FIG. 1) and the hole starting operation is commenced.

After the holes have been started, the drilling operation commences automatically.

When the blast holes have been drilled the drills 3 (FIG. 1) are stopped, and the automatic push-feed devices 88 (FIG. 12) are automatically returned to their initial position, whereafter they are re-positioned. In this way the entire face is drilled off.

Figure 15:
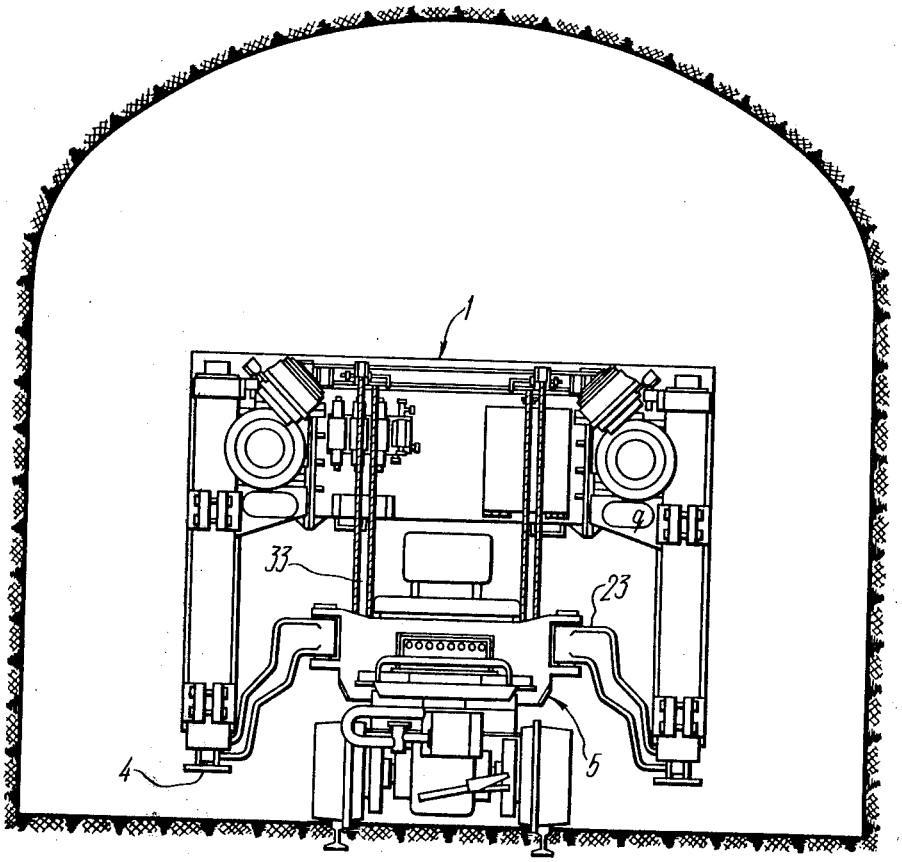
FIG. 15 is a front elevation of the drilling machine in the transportation position.

When the drilling operation is over, the drilling machine is set to the transportation position (FIG. 15).

To set the drilling machine to the tranportation position the lever spreading button 40 (FIG. 3) is depressed on the control console 39, whereby compressed air is supplied via a conduit (not shown) to the actuators (not shown, either) of the control valve 45 (FIG. 2), and the working fluid from the pumping station 51 (FIG. 8) is supplied to the hydraulic cylinders 96 (FIG. 2), the piston rods of the latter actuating the levers 23, spreading the latter and positioning them to underlie the gantry 1. Then, using the conrol console 61 (FIG. 9), there is started the supply of compressed air via the conduit to the actuators 58 (FIG. 10) which operate the slide valves 57, whereby the working fluid from the pumping station 51 is supplied to the hydraulic jacks 4, and the latter are retracted so that the gantry frame 1 lowers to rest on the levers 23 (FIG. 15). The drilling machine has been thus set to the transportation position and is ready for travel.

When the drilling machine is transported along a drift wherein the rail track is offset toward one of the walls, there appears a necessity of moving the gantry frame transversely relative to the longitudinal geometric axis of the bogie 5. This transverse motion of the gantry frame is controlled from the console 39 (FIG. 3) by depression of the corresponding button 41, whereby compressed air operates the slide valve 46 (FIG. 2) on the hydraulic panel 44. The working fluid from the pumping station is supplied via the conduit to the hydraulic cylinder 18 (FIG. 3), whereby its piston rod 19 is displaced.

Since the piston rod 19 abuts against the beam 16, its displacement results in the beam 16 being shifted together with the levers 23 (FIGS. 2, 15) carried thereby, and the gantry frame resting on these levers is also displaced.

Transverse motion of the gantry frame is also utilized at driving of curving drifts, for better indexing of the frame with respect to the face.

When curving drifts are driven, there is also a necessity of rotating the gantry frame about the vertical geometric axis of the bogie 5. For example, such rotation is necessary to position the automatic push-feed device 88 (FIG. 12) properly relative the plane of the face.

The slewing motion of the gantry frame 1 about the vertical geometric axis of the bogie is controlled from the control console 39 (FIG. 3) by depression of the corresponding button 43, whereby through the control valve 48 (FIG. 2) on the hydraulic panel 44 the working fluid is supplied from the pumping station 51 (FIG. 8) to the hydraulic cylinder 30 (FIG. 2) of which the piston rod 30*a* operates the slewing mechanism 25 (FIG. 2) on the bogie. The hydraulic cylinder 18 (FIG. 3) is rotated, its piston rods 19 abutting against the beam 16. The beam 16 rotates with the levers 23, whereby the gantry frame 1 resting on these levers likewise rotates.

Figure 2:
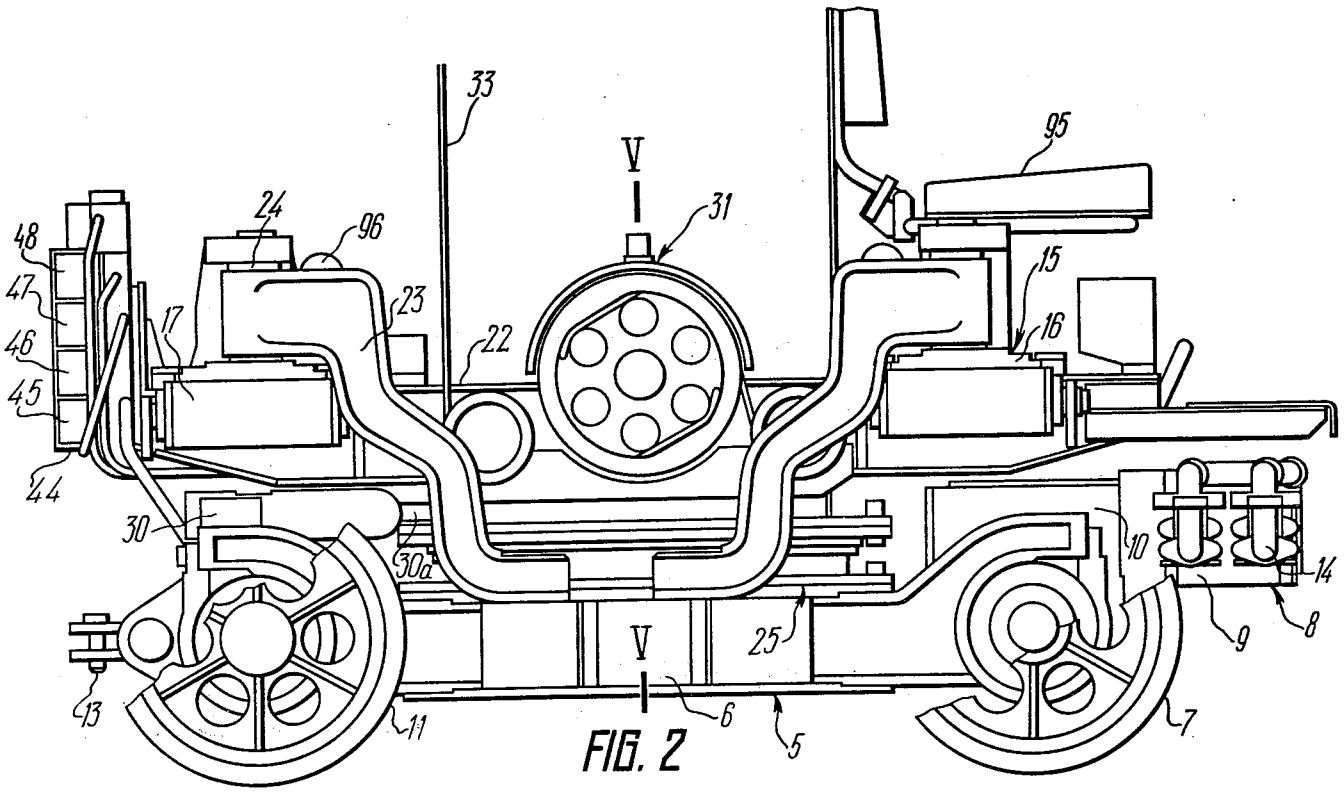
FIG. 2 shows in more detail the bogie 5 of FIG. 1.

The herein disclosed drilling machine is set to the gantry position by using the control console 61 (FIG. 9), whereby compressed air is supplied via the air conduit to the actuators 58 (FIG. 8) of the control valves 57, and the latter are operated to supply the working fluid from the pumping station 51 to the hydraulic jacks 4, projecting the latter. To set the drilling machine to the gantry position the jacks should have their movable parts projected as far as they will go, and the bogie should be lifted to the upper portion of the gantry frame by the bogie-lifting mechanism 31 (FIG. 2).

Figure 3:
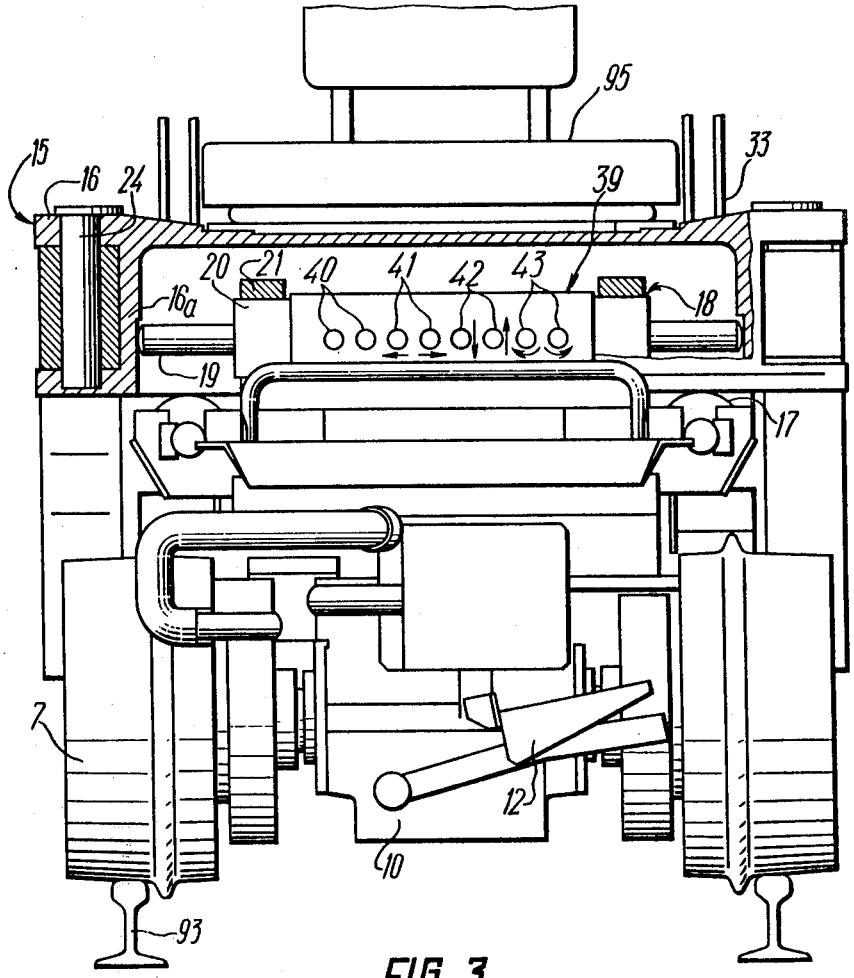
FIG. 3 is a front elevation of the bogie.

Lifting of the bogie 5 to the upper portion of the gantry frame 1 is controlled from the console 39 (FIG. 3). First, the corresponding button 40 is depressed, and compressed air is supplied via the air conduit to the actuators (not shown) of the control valve 45 (FIG. 2), whereby the working fluid is supplied from the pumping station 51 (FIG. 8) to the hydraulic cylinder 96 (FIG. 2), the piston rod of the latter rotating the levers 23 about their pivot pins 24 to fold them on the side of the bogie 5.

Then the corresponding button 42 (FIG. 3) is depressed on the same console 39, and compressed air is supplied via the air conduit to the actuator of the control valve 47 (FIG. 2), whereby the working fluid displaced the pistons 38 (FIGS. 5, 6, 7) of the hydraulic cylinder 37 of the lifting mechanism 31, the pistons displacing the toothed rack 36 which rotates the shaft 35 by the toothed rim 34, the shaft 35 rotating with the drums 32 which wind the rope 33 thereon. With the rope taken in by the drum 32, it hoists the bogie to the upper position of the gantry frame.

Similar operations are performed to lower the bogie, so as to set the drilling machine to the transportation position, whereafter the above described cycle can be repeated.

What we claim is:

1. A machine for drilling holes at driving mine shafts of small to medium cross-sectional area, comprising: a gantry frame supporting the drilling tools thereon; a bogie accommodated within said gantry frame; a beam with projectable abutments upon which said gantry is adapted to bear in the transportation position of the drilling machine being mounted on said bogie along the longitudinal geometrical axis thereof for motion in a transverse direction with respect to the longitudinal geometric axis of said bogie; a mechanism for effecting the transverse motion of said beam; jacks mounted on said gantry frame, and bearing upon the ground in the drilling position and in the gantry position of the drilling machine; means for lifting the jacks off the ground in the transportation position of the drilling machine, said gantry frame being supported by said projectable abutments of said beam; a mechanism for lifting said bogie, said mechanism being mounted on said bogie; and means for flexibly connecting said bogie to said gantry frame.

2. A drilling machine as claimed in calim 1, wherein said beam has side lugs and said bogie has supporting guiding rollers upon which said beam bears by its said side lugs, said mechanism for effecting the transverse motion of said beam with respect to the longitudinal geometric axis of said bogie including a fluid cylinder flixedly mounted on said bogie and having the piston rods thereof projecting from both ends thereof, to both sides of the piston of said cylinder, said rods being adapted to cooperate with said lugs of said beam.

3. A drilling machine as claimed in claim 1, wherein said mechanism for lifting said bogie has a driven shaft mounted on said bogie and carrying thereon at least one drum with one end of a rope attached thereto, the other end of the rope being secured to the upper portion of said gantry frame, whereby said bogie can be lifted to the upper portion of said gantry frame and the drilling machine can be set to the gantry position.

4. A drilling machine as claimed in claim 3, wherein said mechanism for lifting said bogie has two fluid cylinders mounted along the same geometric axis and receiving between the pistons thereof a toothed rack, said driven shaft being rigidly connected with a toothed rim permanently meshing with said toothed rack.

5. A drilling machine as claimed in calim 1, wherein each said projectable abutment includes a Z-shaped lever of which one arm is pivoted to said beam by means of a pivot pin extending vertically, the other arm of said lever being adapted to support thereon said gantry frame in the transport position of the drilling machine.

6. A drilling machine as claimed in claim 2, wherein said bogie is provided with a slewing circle and a fluid cylinder mounted on said bogie and having the piston rod thereof cooperating with said slewing circle, said circle having mounted thereon said guiding rollers supporting said beam and said fluid cylinder effecting motion of said beam in the direction transverse to the longitudinal geometric axis of said bogie, the rods of said last-mentioned fluid cylinder being adapted to cooperate with said side lugs of said beam, whereby, with said slewing circle being rotated by said respective fluid cylinder, said fluid cylinder effecting motion of said beam in a direction transverse to the longitudinal geometric axis of said bogie rotates therewith and effects rotation of said beam cooperating with its rods and movable by said rods over said supporting guiding rollers, said beam supporting said gantry frame on said projectable abutments thereof.

7. A drilling machine fo drilling holes at driving mine drifts of small to medium cross-sectional area, comprising: a gantry frame supporting the drilling tools thereon; a bogie accommodated within said gantry frame; a beam with projectable abutments adapted to support thereon said gantry frame in the transportation position of the drilling machine, said beam being mounted on said bogie along the longitudinal geometric axis thereof with provision for moving in a direction transverse to this axis, said beam having side lugs, said bogie having guiding rollers supporting said side lugs of said beam; a mechanism for effecting motion of said beam in a direction transverse to the longitudinal geometric axis of said bogie, including a fluid cylinder fixedly mounted on said bogie and having the piston rods thereof projecting from both ends thereof, to both sides of the piston of said cylinder, said rods being adapted to cooperate with said lugs of said beam when the drilling machine is set to the transportation position, and to move said beam in either direction from the longitudinal geometric axis of said bogie, displacing together with said beam said gantry frame supported by said projectable abutments of said beam; jacks mounted on said gantry frame, by which said frame bears upon the ground in the drilling position and in the gantry position of the drilling machine; means for lifting said jacks off the ground in the transportation position of the drilling machine when said gantry frame bears upon said projectable abutments of said beam; a mechanism for lifting said bogie, mounted on said bogie which is kinematically operatively connected with said gantry frame and includes a driven shaft carrying at least one drum having one end of a rope attached thereto, the other end of the rope being secured to the upper portion of said gantry frame, whereby said bogie can be lifted to said upper portion of said gantry frame and the drilling machine can be set to the gantry position, the drive of said mechanism for lifting said bogie including two fluid cylinders mounted along the same geometric axis and receiving a toothed rack between the pistons thereof and also including a toothed rim rigidly connected with said driven shaft and permanently meshing with said toothed rack; each one of said projectable abutments of said beam including a Z-shaped lever having one arm thereof pivoted to said beam by means of a pivot pin extending vertically, the other arm thereof being adapted to support thereon said gantry frame in the transportation position of the drilling machine, whereby said bogie can be lifted to the upper portion of said gantry frame; said bogie being provided with a slewing circle arranged at the central portion thereof and a fluid cylinder mounted on said bogie and having the piston rod thereof cooperating with said slewing circle, the latter supporting thereon said guiding rollers supporting said beam and said fluid cylinder effecting motion of said beam in a direction transverse to the longitudinal geometric axis of said bogie, the piston rods of which cooperate with said side lugs of said beam, whereby, when said respective fluid cylinder effects rotation of said slewing circle, there is effected rotation of said fluid cylinder effecting motion of said beam in a direction transverse to the longitudinal geometric axis of said bogie, this rotation resulting in corresponding rotation of said beam cooperating with the piston rods of the last-mentioned cylinder and being adapted to be moved by these rods over said supporting guiding rollers, said beam supporting said gantry frame on said projectable abutments.

* * * * *